US005513783A

United States Patent [19]

White

[11] Patent Number: 5,513,783

[45] Date of Patent: May 7, 1996

[54] TOOL FOR FACILITATING APPLICATION OF ELASTIC STOCKINGS

[76] Inventor: Allen A. White, R.F.D. 2, Box 9, Peabody, Kans. 66866

[21] Appl. No.: 329,160

[22] Filed: Oct. 26, 1994

[51] Int. Cl.[6] ..... A47G 25/80; B25B 7/02

[52] U.S. Cl. ..... 223/112; 81/303; 81/302; 223/111

[58] Field of Search ..... 223/111, 112; 81/302, 303, 304; 606/207, 208; 294/116

[56] References Cited

U.S. PATENT DOCUMENTS

| | | | |
|---|---|---|---|
| 131,188 | 12/1872 | Sneider . | |
| 1,092,104 | 3/1914 | Hill . | |
| 1,095,054 | 4/1914 | Weisenfeld . | |
| 1,315,096 | 9/1919 | Deiley . | |
| 1,539,526 | 5/1925 | Swickard . | |
| 1,884,643 | 10/1932 | Forbes . | |
| 2,173,010 | 9/1939 | De Amario . | |
| 2,196,441 | 4/1940 | Knapp . | |
| 2,214,985 | 9/1940 | Bachmann . | |
| 2,542,027 | 2/1951 | Hodell | 294/116 |
| 2,840,082 | 6/1958 | Salvatore . | |
| 3,130,484 | 4/1964 | Zdanis | 81/303 |
| 3,233,313 | 2/1966 | Roth | 81/302 |
| 3,263,535 | 8/1966 | Zurcher . | |
| 3,310,209 | 3/1967 | Clauss . | |
| 3,727,812 | 4/1973 | Weiss . | |
| 3,853,252 | 12/1974 | Scianimanico . | |
| 3,869,793 | 3/1975 | Ferguson . | |
| 3,916,907 | 11/1975 | Peterson . | |
| 4,072,255 | 2/1978 | Bogorad . | |
| 4,789,087 | 12/1988 | Doorenbos . | |
| 5,249,720 | 10/1993 | White . | |
| 5,336,228 | 8/1994 | Cholau | 81/304 |

*Primary Examiner*—C. D. Crowder
*Assistant Examiner*—Bibhu Mohanty
*Attorney, Agent, or Firm*—Shook, Hardy & Bacon

[57] ABSTRACT

An improved tool for assisting the application of a stocking to a user's leg is provided. The tool includes a pair of curvilinear arms with side rails mounted for lateral pivotal movement in a first plane between a closed position, wherein the side rails are in close proximity for receiving a stocking, and an open position, wherein the side rails are relatively spaced apart to outwardly stretch the stocking for application to the user's leg. An elongated bar having a tongue is mounted to the arms for pivotal movement in a second plane generally perpendicular to the first plane of movement. The tool further includes means operably coupled to the bar for moving the bar in the second plane between a disposition wherein the tongue is in close proximity with the rails when the tool in the closed position, and a disposition wherein the tongue is relatively spaced away from both rails when the tool is in the open position.

20 Claims, 2 Drawing Sheets

10.
6.

TOOL FOR FACILITATING APPLICATION OF ELASTIC STOCKINGS

BACKGROUND OF THE INVENTION

This invention relates generally to orthopedic devices and, more particularly, to an improved tool for facilitating the application of elastic or support stockings to an individual's leg.

Many individuals with circulatory disorders must wear tight-fitting hosiery or stockings to provide constrictive force to their feet and lower legs, thereby reducing the pooling of fluids. Due to the strongly elastic nature of these stockings, many persons find it difficult to exert the force needed to apply the stockings. In addition, many of these individuals lack the necessary flexibility to bend their legs or torso to the degree needed to apply support stockings or, for that matter, even ordinary socks.

To assist these individuals, applicant previously devised the tool of U.S. Pat. No. 5,249,720 (the '720 patent), which is incorporated in its entirety by reference herein. The tool of the '720 patent includes a pair of side rails connected to handles and mounted for lateral movement between a closed position, wherein the rails are held together for receiving a stocking, and an open position, wherein the rails outwardly stretch the stocking for placement over the foot and leg of the user. An independently laterally movable tongue is secured to the tool at a position above the side rails also to receive the stocking. The tongue of the tool of the '720 patent is not adapted to move inwardly toward the side rails in the closed position, thus requiring that the stocking be initially stretched over the tongue by the user. While applicant's '720 tool functioned and continues to function extremely well for many individuals, some users may find the necessary initial stretching of the stocking inconvenient.

SUMMARY OF THE INVENTION

It is, therefore, an object of the present invention to provide a tool for use in the application of stockings that provides the many benefits of applicant's previously devised tool without requiring the user to initially stretch the stocking before use.

More specifically, it is an object of the present invention to provide an improved tool for assisting the application of an elastic stocking that permits the tongue to pivotally move simultaneously with the side rails in a plane substantially perpendicular to the plane of lateral movement of the side rails between a closed position, wherein the tongue is held in close proximity to the side rails, and an open position, wherein the tongue is relatively spaced away from both side rails.

It is another object of the present invention to provide an improved tool wherein the tongue is mounted to an elongated member which is adapted to place the tongue in disposition to bisect the angle between the side rails at all times, thereby ensuring proper positioning of the tongue on the leg of the user.

It is a further object of the present invention to provide an improved tool having positive acting means on the elongated member for both moving the tongue along its path of movement and for centering the tongue between the side rails, whereby both functions take place concurrently and continuously relative to the positioning of the handles of the tool.

It is yet a further object of the present invention to provide an improved tool having a simple singular securing means that pivotally interconnects the side rails to the elongated member to allow the side rails to pivotally move in a lateral plane while simultaneously permitting the elongated member to move in a plane substantially perpendicular to the plane of lateral movement of the side rails.

It is still another object of the present invention to provide an improved tool that achieves a mechanical advantage at its side rails and tongue by manipulating the handles of the tool.

To accomplish these and other related objects, the present invention provides an improved tool for facilitating the application of an elastic stocking to an individual's leg. In the preferred embodiment, the improved tool includes a pair of interconnected arms having side rails at their respective distal ends and handles at their respective proximal ends. The arms are laterally movable between a closed position, wherein the side rails are in close spatial proximity, and an open position, wherein the side rails are relatively spaced apart. An elongated member having a tongue at its front end is mounted to the arms for movement in a plane substantially perpendicular to the plane of lateral movement of the arms. Positive acting means are disposed on the elongated member and are operably coupled with the arms for moving the tongue between a disposition in close proximity with the side rails when the tool is in closed position, so that an elastic stocking may be telescoped over the side rails and tongue, and relatively spaced apart from both side rails when the tool is in the open position, whereby the side rails and tongue outwardly stretch the stocking.

BRIEF DESCRIPTION OF THE DRAWINGS

In the accompanying drawings, which form part of, and are to be read in conjunction with the specification, reference numerals have been used to indicate like parts in the various views.

DESCRIPTION OF THE PREFERRED EMBODIMENT

Figures 1, 2, 3, 4:
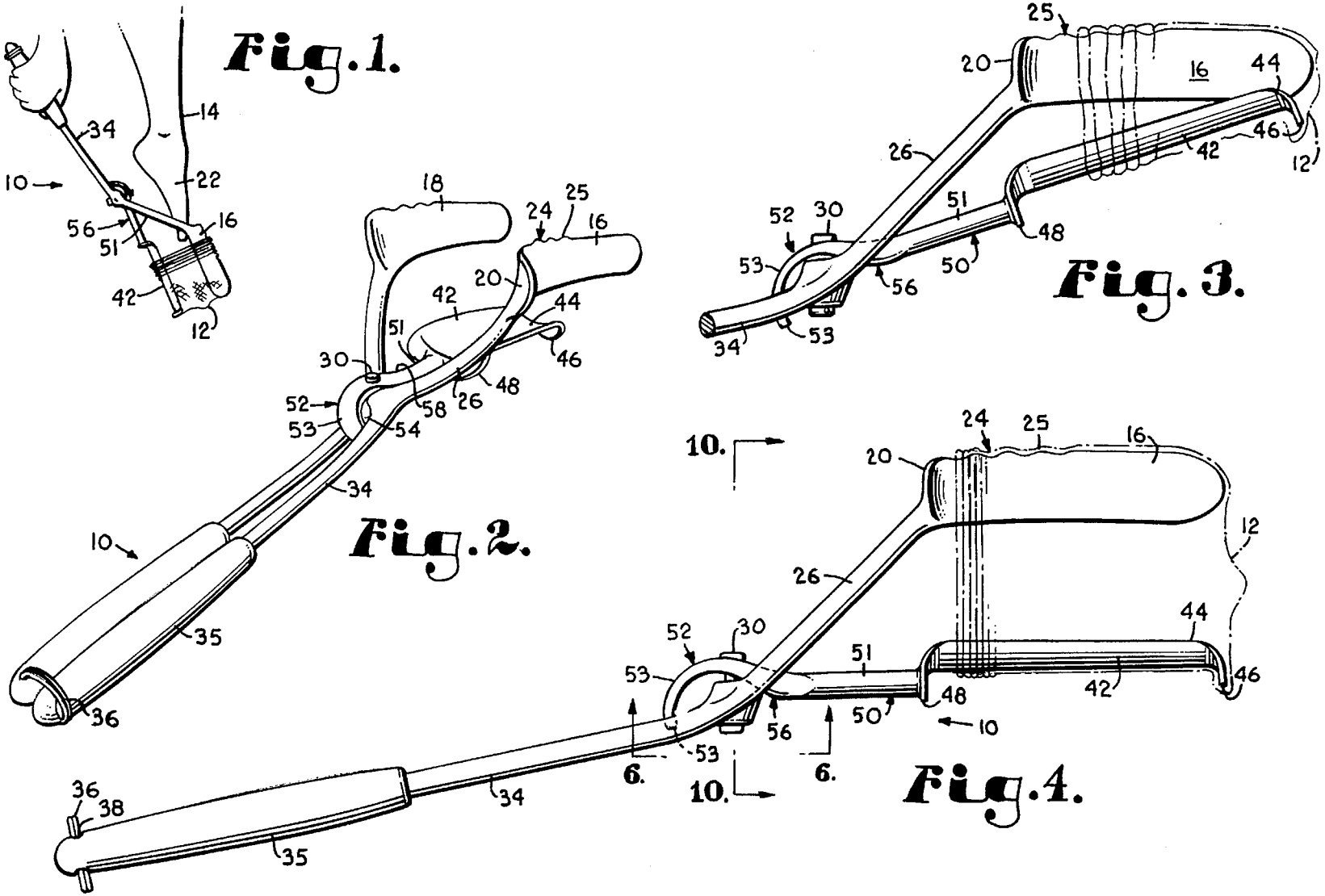
FIG. 1 is a fragmentary side elevational view on a reduced scale of a person using the tool of the present invention to assist in the application of an elastic support stocking.
FIG. 2 is a top perspective view of the tool shown in FIG. 1.
FIG. 3 is an enlarged fragmentary side elevational view of the tool in FIG. 2 but shown in closed position and illustrating in phantom lines a stocking being telescoped over the side rails and tongue.
FIG. 4 is a view similar to FIG. 3 but showing the tool in open position outwardly stretching the stocking.

Referring now to the drawings in greater detail, a tool in accordance with the present invention is designated broadly by the numeral 10. Tool 10 is constructed for use in applying a stocking 12 to an individual's leg 14. The stocking 12 may be a highly elastic support stocking useful in the treatment of circulatory disorders or it may be an ordinary sock.

The tool 10 includes a pair of side rails 16 which are elongated and have slightly concave facing surfaces 18. The side rails 16 each include an end portion 20 that is bent outwardly to prevent the tool from entering too far into of stocking 12 and to avoid abrasive contact of the edge of the end portions 20 with the individual's leg 14. The bent end portions 20 also serve to help guide the individual's foot 22 between the side rails 16 when the foot is inserted into the stocking 12. Each side rail 16 also includes an irregular upper edge 24 preferably having a series of blunt undulations 25 to increase the frictional engagement between stocking 12 and rails 16, thereby reducing the tendency for stocking 12 to slip along rails 16.

Side rails 16 are each rigidly mounted to a rod 26 which is suitably connected to and, preferably, integral with the end portion 20 of the associated side rail 16. Rods 26 are curvilinear and include mutually overlapping ears 28 that are secured together by a flat-headed pin or rivet 30. The rivet 30 also serves as an axis about which the rods 26 may be manually pivoted to move the side rails 16 closer together or farther apart.

Beyond the pivot axis defined by rivet 30, rods 26 form handles 34 which may be grasped by the user of tool 10 and manipulated to cause the lateral movement of side rails 16. Handles 34 are of suitable length to impart a mechanical advantage at rods 26, thereby achieving substantial leverage at the ends of rods 26 to allow stretching of the stocking 12 without significant exertion by the user. Handles 34 may further include grips 35 suitably mounted to the handles in disposition for being grasped by the user.

A latch means preferably in the form of a ring 36 extends through a hole 38 in the end of one of the grips 35 and may be positioned over the other grip 35 to lock the handles together and prevent their separation. A circumferential groove 40 is provided in the other grip 35 to receive and seat ring 36.

An elongated extension member 50 is mounted to tool 10 for pivotal movement in a plane substantially perpendicular to the plane of lateral movement of side rails 16. Member 50 includes a front region 51 that extends forwardly from rivet 30 between rods 26 and below the side rails 16, and a rear region 52 that projects rearwardly from rivet 30 and between handles 34.

A tongue 42 is suitably mounted on and, preferably, integrally formed with the end of the front region 51. Tongue 42 includes a slightly concave upper surface 44 adapted to conform to the rear of the user's leg 14. Tongue 42 also includes a downturned forward lip 46 which functions to prevent abrasive contact of tongue 42 with the leg 14 and to promote easy passage of the tongue 42 over the heel. Tongue 42 also has a downturned rear lip 48 to reduce any tendency of the tool to slip too far into stocking 12.

The rear region 52 of extension member 50 defines a downturned projection 53 captured between handles 34. Projection 53 includes downwardly converging camming edges 54 adapted to be engaged by handles 34 so that as handles 34 are moved inwardly, projection 53 is forced or cammed upwardly. Camming edges 54 are preferably smooth and rounded to allow smooth camming movement of projection 53 between handles 34.

The front region 51 of extension member 50 includes a neck 56 captured between rods 26. Neck 56 has outwardly converging camming edges 58 adapted to be engaged by rods 26 so that as rods 26 are moved inwardly, neck 56 will be forced upwardly by the rods. Camming edges 58 are also preferably smooth and rounded to promote more fluid camming movement of neck 53 between handles 34.

It is important to note that the camming functioning of projection 53 and neck 56 are reciprocally positive acting. In other words, the respective camming operations of projection 53 with handles 34 and neck 56 with rods 26 are constant and inversely related. Thus, while the inward movement of handles 34 causes projection 53 to move upwardly, neck 56 is simultaneously camming downwardly between rods 26. Conversely, as neck 56 is being cammed upwardly by rods 26, projection 53 is concurrently camming downwardly between handles 34. This cooperative positive action ensures a tight operation of tool 10 with minimal tolerances, thereby improving the stability and mechanical efficiency of the tool 10.

It is also important to recognize that the reciprocal positive acting camming arrangement of tool 10 provides a centering function. Because projection 53 and neck 56 are in constant but reciprocal camming engagement with handles 34 and rods 26, respectively, the pivotal rocking movement of member 50 is maintained generally linear. This linear movement occurs in a plane substantially perpendicular to the plane of lateral movement of side rails 16. Consequently, tongue 42 is constantly maintained in disposition substantially bisecting the angle between the side rails 16, thus centering tongue 42 between side rails 16 at all times.

Figures 5, 6, 7, 8, 9, 10:
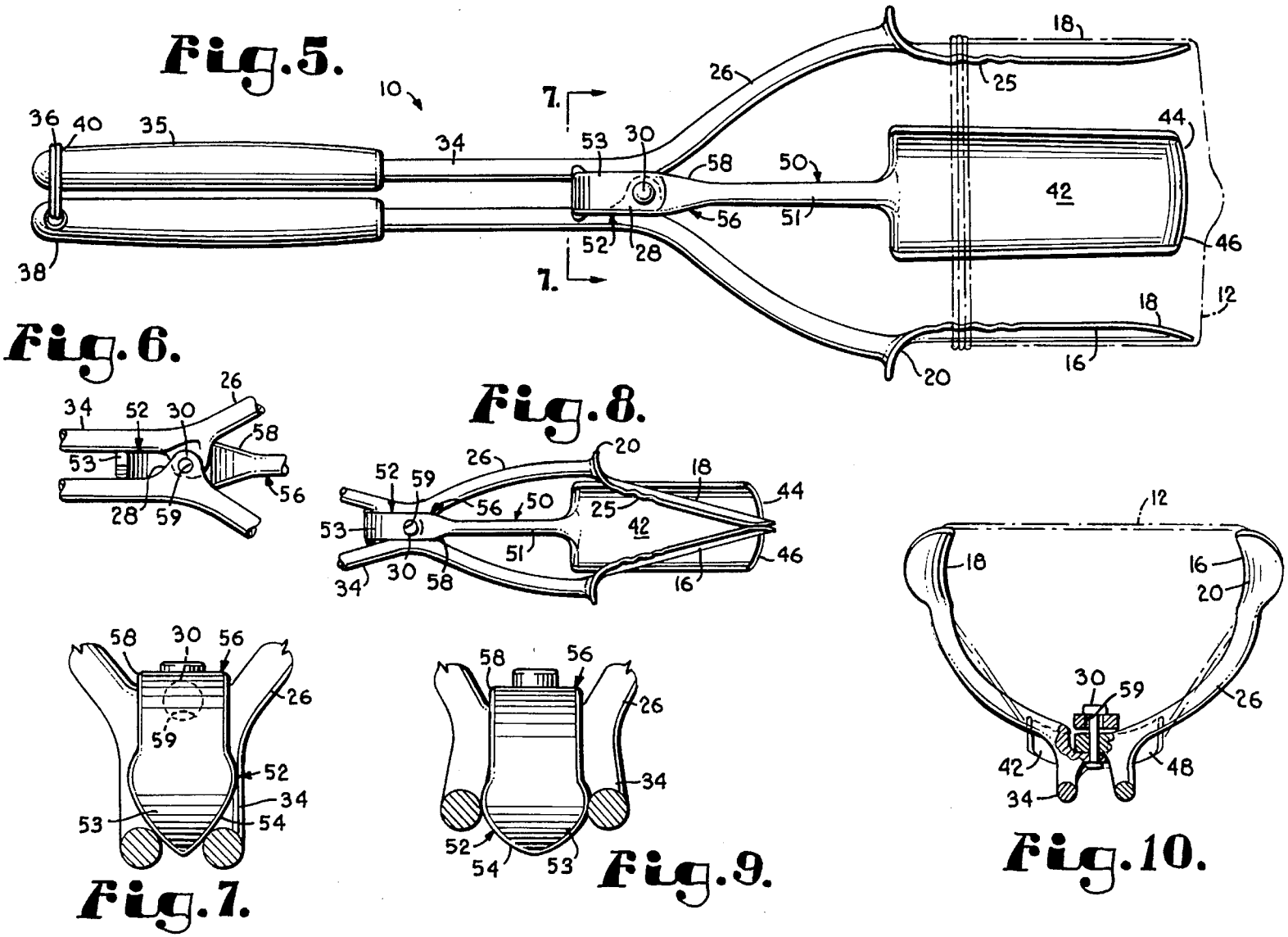
FIG. 5 is a bottom plan view of the tool in FIG. 4, a stocking appearing fragmentally in phantom.
FIG. 6 is a fragmentary elevational view taken along line 6—6 of FIG. 4 showing the coupling region of the tool, the shape of some hidden parts being shown in broken lines to reveal details of construction.
FIG. 7 is an enlarged fragmentary cross-sectional view taken along line 7—7 of FIG. 5.
FIG. 8 is a fragmentary bottom plan view on a reduced scale of the tool of the present invention showing the tool in closed position with the side rails and tongue in close spatial proximity.
FIG. 9 is a view similar to FIG. 7 but showing the tool in closed position.
FIG. 10 is a detailed cross-sectional view taken along line 10—10 of FIG. 4, parts being broken away and shown in cross section to reveal details of construction.

Member 50 is preferably mounted to tool 10 by rivet 30 which extends through a hole 59 in the member as shown in FIG. 10. Rivet 30 serves a unique three-fold function: First, and most apparent, rivet 30 couples rods 26 with member 50. Second, rivet 30 functions as an axis for laterally pivotal movement of the rods 26. Third, rivet 30 allows pivotally rocking movement of the member 50 in a plane substantially perpendicular to the plane of lateral movement of rods 26. To provide the third function, the hole 59 in member 50 is slightly larger than the cross-sectional diameter of rivet 30 and ovular in shape to present somewhat of a loose fit, which allows the necessary longitudinal tolerance to accommodate the rocking motion of member 50. While a rivet is preferred for this three-fold function, other coupling means, such as a dual-axis coupler, a T-shaped bar and the like, may also be employed without departing from the scope of the invention.

In operation, the handles 34 of tool 10 are first spread outwardly apart by the user, thereby moving the side rails 16 laterally inwardly to a position which they are closely spaced together at their leading ends. As side rails 16 are moved together, rods 26 simultaneously apply inwardly opposing force to the camming edges 58 of neck 56, thereby forcing neck 56 upwardly. The upward movement of neck 56 forces tongue 42 upwardly proximal the side rails 16 on a plane generally perpendicular to the lateral movement of side rails 16. In closed position, a stocking 12 may be telescoped over the side rails 16 and tongue 42, as illustrated in phantom in FIG. 3.

After stocking 12 is placed over side rails 16 and tongue 42, the user applies inwardly squeezing force to grips 35 of handles 34 to cause lateral spreading of the side rails 16. The inward movement of handles 34 simultaneously applies inwardly opposed force to the camming edges 54 of projection 53, thereby camming the projection 53 upwardly and, in turn, moving tongue 42 downwardly. The lateral outward movement of side rails 16 and downward movement of tongue 42 stretches stocking 12 to a suitable circumference to receive the foot 22 of the user, as shown in FIG. 4.

Tool 10 may be locked in this open position by placing the latch ring 36 over the grip 35 of the other handle 34. The ring 36 counteracts the constrictive force exerted by the stocking 12 on side rails 16 and tongue 42 and maintains the structures in the open position. Because the latching ring 36 maintains the tool 10 in the open position, the tool 10 may be manipulated by one hand of the user without the necessity for continuous application of squeezing force on the handles 34.

The foot 22 of the individual is then inserted into the outwardly stretched stocking 12, as shown in FIG. 1. Tool 10 is manipulated to move the stocking upwardly onto the leg 14. The concave surfaces 18 of the side rails 16 and the concave upper surface 44 of tongue 42 are shaped to be in general conformity with the foot 22 and leg 14 of the user. The downwardly turned lip 46 of tongue 42 functions somewhat as a shoe horn to assist the movement of tool 10 past the heel. Once the stocking 12 has been placed in the desired position on the leg 14, the tool 10 is slid rearwardly out of the stocking 12. The constrictive force exerted by stocking 12 on the leg 14 together with the extreme end of the stocking 12 contacting the user's toes holds the stocking 12 in position as tool 10 is removed. The ring 36 is then disengaged from the other handle 34 to prepare for the application of another stocking 12.

The unique construction of member 50 cooperates advantageously with the pivotally interconnected members to achieve the novel functioning of tool 10. The relatively long handles 34 provide the user with substantial mechanical advantage so that the tool can be easily used to overcome the constrictive force encountered when outstretching support hose or elastic stockings. This same relatively large mechanical advantage is utilized in the operation of tool 10 to move member 50 to and from its open position. The projection 53 and neck 56 of member 50 are captured between handles 34 and rods 26, respectively, and maintains member 50 at its position substantially bisecting the angle between the side members at all times, notwithstanding that the angle is ever changing during movement of the side members. All the while, the reciprocal positive acting camming operations of projection 53 and neck 56 cause tongue 42 to move on a path of travel generally perpendicular to the movement of the side rails 16. Thus, the pivoting members themselves power the tongue 42 between its extreme positions, so that the tongue 42 not only aids in forcing the stocking open, but it also is moved positively to its closed position, readying the tool 10 for insertion into another stocking.

From the foregoing, it is clear this invention is well-adapted to attain the objects set forth above together with other advantages that are inherent to the invention.

It will be understood that certain features and subcombinations are of utility and may be employed without reference to other features and subcombinations. This is contemplated by and is within the scope of the claims.

Because many possible embodiments may be made of the invention without departing from its scope, it is to be understood that all matter set forth herein or shown in the accompanying drawings is to be interpreted as illustrative and not in a limiting sense.

The following is claimed:

1. In a tool for use in applying a stocking to an individual's leg including a pair of elongated, relatively rigid members, each said member having a proximal portion and a distal portion pivotally interconnected intermediate their respective portions, whereby manual swinging of the members about the pivotal interconnection moves the distal portions in a first plane of movement between a closed position, with the distal portions in close proximity so as to permit a stocking to be telescoped over the distal portions, and an open position, wherein the distal portions are spaced relatively further apart so as to outwardly stretch the stocking, and also having a tongue carried by the members in disposition for engaging the individual's leg during the application of the stocking, the improvement comprising:

an elongated element rigidly secured to the tongue;

means pivotally coupling the element to the members for rocking movement of the tongue in a second plane generally perpendicular to said first plane of movement; and means operably coupled with the members and the element for moving the element in the second plane to dispose the tongue in close proximity to the distal portions when the tool is in said closed position, and to space the tongue relatively further from both distal portions when the tool is in said open position.

2. The improved tool of claim 1 wherein said element includes a rear region and a front region, said element being pivotally coupled to said members intermediate said rear and front regions.

3. The improved tool of claim 2 wherein said moving means includes a neck disposed on the front region of the element and having outwardly converging camming edges captured between the distal portions of the members so that as said tool is moved to the closed position, said distal portions apply inwardly opposed force to the camming edges of said neck, thereby forcing the tongue upwardly toward said distal portions.

4. The improved tool of claim 3 wherein said moving means includes a downturned projection disposed on the rear region of the element and having downwardly converging camming edges captured between the proximal portions of said members so that as tool is moved to said open position, said proximal portions apply inwardly opposed force to the camming edges of said projection, thereby forcing the tongue downwardly away from said distal portions.

5. The improved tool of claim 4 further comprising side rails mounted to each said distal portion, each said side rail being concave and including a rear end, a front end, an upper edge and a lower edge, said rear end being outwardly flared.

6. The improved tool of claim 5 wherein the upper edge of each said side rail includes an irregular surface adapted to increase the frictional engagement between the side rails and the stocking, thereby resisting slippage of the stocking along the rails.

7. The improved tool of claim 6 wherein said tongue is concave and includes a downturned rear edge and a downturned front edge, said rear edge being mounted to said front region of said element.

8. The improved tool of claim 7 wherein said coupling means includes a flat-headed rivet extending through said members and said element, said pin providing somewhat of a loose fit for said element to allow pivotally rocking movement of the element in a plane substantially perpendicular to the plane of lateral movement of said members.

9. The improved tool of claim 8 further comprising a latch means mounted of the members for releasably securing the tool in the open position.

10. The improved tool of claim 9 wherein the latch means comprises a ring secured to the proximal portion of one member and adapted for placement over the other member to maintain the proximal portions in close spatial proximity.

11. A tool for assisting the application of a stocking to a user's leg comprising:

a pair of curvilinear arms each having a proximal portion and a distal portion and mounted intermediate their respective portions for pivotal movement in a first plane between an open position, wherein the proximal portions are in close proximity and the distal portions are relatively spaced apart, and a closed position, wherein the distal portions are in close proximity and the proximal portions are relatively spaced apart;

a pair of side rails mounted to said distal portions and adapted to receive a stocking when the arms are in the closed position, and to outwardly stretch the stocking when the arms are moved to the open position;

a bar having a front region and a rear region mounted to said arms intermediate said regions for rocking pivotal movement in a second plane generally perpendicular to said first plane of movement;

a tongue mounted to said front region adapted to receive and outwardly stretch said stocking; and means for moving said bar in said second plane between a disposition wherein the tongue is in close proximity to said rails when the arms are in the closed position, and a disposition wherein the tongue is relatively spaced apart from both rails when the arms are in the open position.

12. The improved tool of claim 11 wherein said moving means includes a neck disposed on the front region of the bar and having outwardly converging camming edges captured between the distal portions of the members so that as said tool is moved to the closed position, said distal portions engage said neck, thereby forcing said tongue upwardly toward said rails.

13. The improved tool of claim 12 wherein said moving means includes a downturned projection disposed on the rear region of the bar and having downwardly converging camming edges captured between the proximal portions of said members so that as tool is moved to said open position, said proximal portions engage said projection, thereby forcing said tongue downwardly away from both said rails.

14. The tool of claim 13 wherein each said rail is concave and includes a outwardly flared rear edge secured to said distal portion of said arm, an upper edge and a lower edge.

15. The tool of claim 14 wherein said upper edge of the rails includes an irregular surface adapted to increase the frictional connection between the rails and the stocking, thereby resisting slippage of the stocking along the rails.

16. The tool of claim 15 wherein said tongue is concave and includes a downturned rear edge mounted to the front region of the bar and a downturned front edge.

17. The tool of claim 16 further comprising a coupling means for securing said bar to said arms comprising an elongated member extending through the arms and the bar, said member providing somewhat of a loose fit for the bar to allow pivotally rocking movement of the bar about an axis substantially perpendicular to the axis of the member.

18. The tool of claim 17 wherein said member is a flat-headed rivet.

19. The tool of claim 18 further comprising a latch mounted for releasably securing said proximal portions together to maintain said arms in the open position.

20. A tool for assisting the application of a stocking to a user's leg comprising:

a pair of curvilinear arms, each said arm having a distal portion and a proximal portion, said arms being secured to each other for pivotal movement in a first plane between an open position, wherein the proximal portions are in close proximity and the distal portions are outwardly relatively spaced apart, and a closed position, wherein the proximal portions are outwardly relatively spaced apart and the distal portions are in close proximity;

a pair of side rails having inwardly facing concave surfaces mounted to the distal portions of said arms and adapted to receive a stocking when the arms are in the closed position and to outwardly stretch the stocking when the arms are moved to the open position;

a bar having a front region and a rear region pivotally mounted to said arms intermediate said regions for movement in a second plane generally perpendicular to said first plane, said rear region including an downturned projection having downwardly converging camming surfaces captured between the proximal portions of the arms, said camming projection being frictionally operable against said proximal portions to force the rear region of the bar downwardly away from the rails when the arms are placed in the open position, and said front region including a neck having outwardly converging camming surfaces captured between the distal portions of the arms, said camming neck being frictionally operable against said distal portions to force the rear region of the bar upwardly toward the rails when the arms are placed in the closed position;

a tongue having an upwardly facing concave surface secured to the front region of the bar and adapted to receive a stocking when the arms are in closed position and to outwardly stretch the stocking when the arms are moved to the open position; and a means for pivotally coupling said arms to said bar, said coupling means allowing arms to pivot for movement in the first plane and further allowing bar to pivot for movement in the second plane.

* * * * *

UNITED STATES PATENT AND TRADEMARK OFFICE

CERTIFICATE OF CORRECTION

PATENT NO. : 5,513,783
DATED : May 7, 1996
INVENTOR(S) : Allen A. White

It is certified that error appears in the above-indentified patent and that said Letters Patent is hereby corrected as shown below:

Column 2, line 50 of the printed patent, delete the word "bottom" and insert the word --top--.

Column 2, line 58 of the printed patent, delete the word "bottom" and insert the word --top--.

In line 14 of the Abstract of the printed patent, after the word "tool", please insert the word --is--.

Signed and Sealed this

Twenty-sixth Day of November 1996

*Attest:*

Bruce Lehman

BRUCE LEHMAN

*Attesting Officer*

*Commissioner of Patents and Trademarks*